US005417413A

United States Patent [19]

Huffman et al.

[11] Patent Number: 5,417,413

[45] Date of Patent: May 23, 1995

[54] UNIFORM MEDIA TENSIONING OF PRINT MEDIA DURING TRANSPORT IN LASER PRINTER

[75] Inventors: John W. Huffman, Meridian; Paul K. Mui; Kwesi E. Abraham, both of Boise; Michael F. Webster, Meridian, all of Id.

[73] Assignee: Hewlett-Packard Company, Palo Alto, Calif.

[21] Appl. No.: 229,040

[22] Filed: Apr. 18, 1994

[51] Int. Cl.[6] ..... B65H 5/00

[52] U.S. Cl. ..... 271/225; 271/270; 271/184; 226/198

[58] Field of Search ..... 271/225, 270, 184–186, 271/232, 10, 273; 226/151, 189, 195, 198

[56] References Cited

U.S. PATENT DOCUMENTS

| | | | |
|---|---|---|---|
| 3,851,839 | 12/1974 | Hynes | 226/195 |
| 4,353,540 | 10/1982 | Beery | 271/270 |
| 4,526,361 | 7/1985 | Dubois | 271/270 |
| 4,669,646 | 6/1987 | Oinerer | 226/198 |
| 5,203,217 | 4/1993 | Buckley | 271/273 |
| 5,320,339 | 6/1994 | Thomas et al. | 271/225 |

FOREIGN PATENT DOCUMENTS

| | | | |
|---|---|---|---|
| 0122566 | 9/1979 | Japan | 271/270 |
| 0211263 | 9/1987 | Japan | 271/270 |
| 0178163 | 7/1990 | Japan | 271/270 |

*Primary Examiner*—H. Grant Skaggs
*Attorney, Agent, or Firm*—Anthony J. Baca

[57] ABSTRACT

An input roller pushes the media through the electrophotographic device at a given linear velocity. An output roller pulls the media through the electrophotographic device after the media leaves the input roller. The output roller has a linear velocity greater then the input roller's linear velocity. In-between the input and output rollers is a variable media path having an arcuate shape. A compressible media guide is placed along the concave side of the variable media path. As the media is pulled faster by the output roller, the variable media path decreases. The compressible media guide begins to compress thereby creating a constant tension in the media as it passes through the electrophotographic device. By keeping the media under a constant pressure, the likelihood of deformations is greatly reduced.

13 Claims, 6 Drawing Sheets

UNIFORM MEDIA TENSIONING OF PRINT MEDIA DURING TRANSPORT IN LASER PRINTER

TECHNICAL FIELD

This invention relates generally to electrophotographic printing also known as laser printing and more particularly to an improved media tensioning arrangement for use in a desktop type laser printer. This arrangement is useful to reduce curl and wave produced by these printers.

BACKGROUND OF THE INVENTION

In a typical laser printer the media transport system may compose five major areas: (1) Pickup; (2) Registration; (3) Imaging; (4) Fuser; and (5) Output. Each area uses one or more rollers to move the media through the area. The linear velocities of all the rollers in the gear train are designed to be the same so that media transport speeds are synchronized in all areas. However, because of manufacturing process, part tolerances, material differences and different wearing characteristics of the rollers and gear train, the linear velocities of the rollers vary to a certain extent. As a result, media deformation such as waves, crimp, curl, wrinkles, paper jams, and print quality can occur.

For example, if the output roller's linear velocity is slower than that of the fuser roller, the fuser roller will feed the output roller more media than the output roller can handle causing media to start backing up, buckling up and folding up at the exit area of the fuser. Because of the high temperature in the fuser, the media exiting from the fuser is still in plastic form. As a result, permanent waves or deformation are formed in the backed up, buckled up, and folded up portion of the media. This phenomenon is more pronounced as the length of the media increases from A size (11 inches long) to B size (17 inches long) because of large length and velocity deferential. Paper jams can also occur because of this phenomenon.

If the output roller's linear velocity is faster than the fuser roller, the output roller pulls more media than the fuser roller can feed. As a result, the media is stretched at the fuser exit area while it is still in plastic form. Again, media deformation occurs and print quality may also be affected additionally, the media may also be torn.

SUMMARY OF THE INVENTION

In order to accomplish the objective of the present invention, there is provided an apparatus operative within an electrophotographic device for reducing deformation in a media. The apparatus uses an input roller that pushes the media through the electrophotographic device at a given linear velocity. An output roller pulls the media through the electrophotographic device after the media leaves the input roller. The output roller has a linear velocity greater then the input roller's linear velocity. In-between the input and output rollers is a variable media path where the variable media path has an arcuate shape. A compressible media guide is placed along the concave side of the variable media path. As the media is pulled faster by the output roller, the variable media path decreases. The compressible media guide begins to compress thereby creating a constant tension in the media as it passes through the electrophotographic device. By keeping the media under a constant pressure, the likelihood of deformations is greatly reduced.

DETAILED DESCRIPTION OF THE PREFERRED EMBODIMENTS

Figure 1:
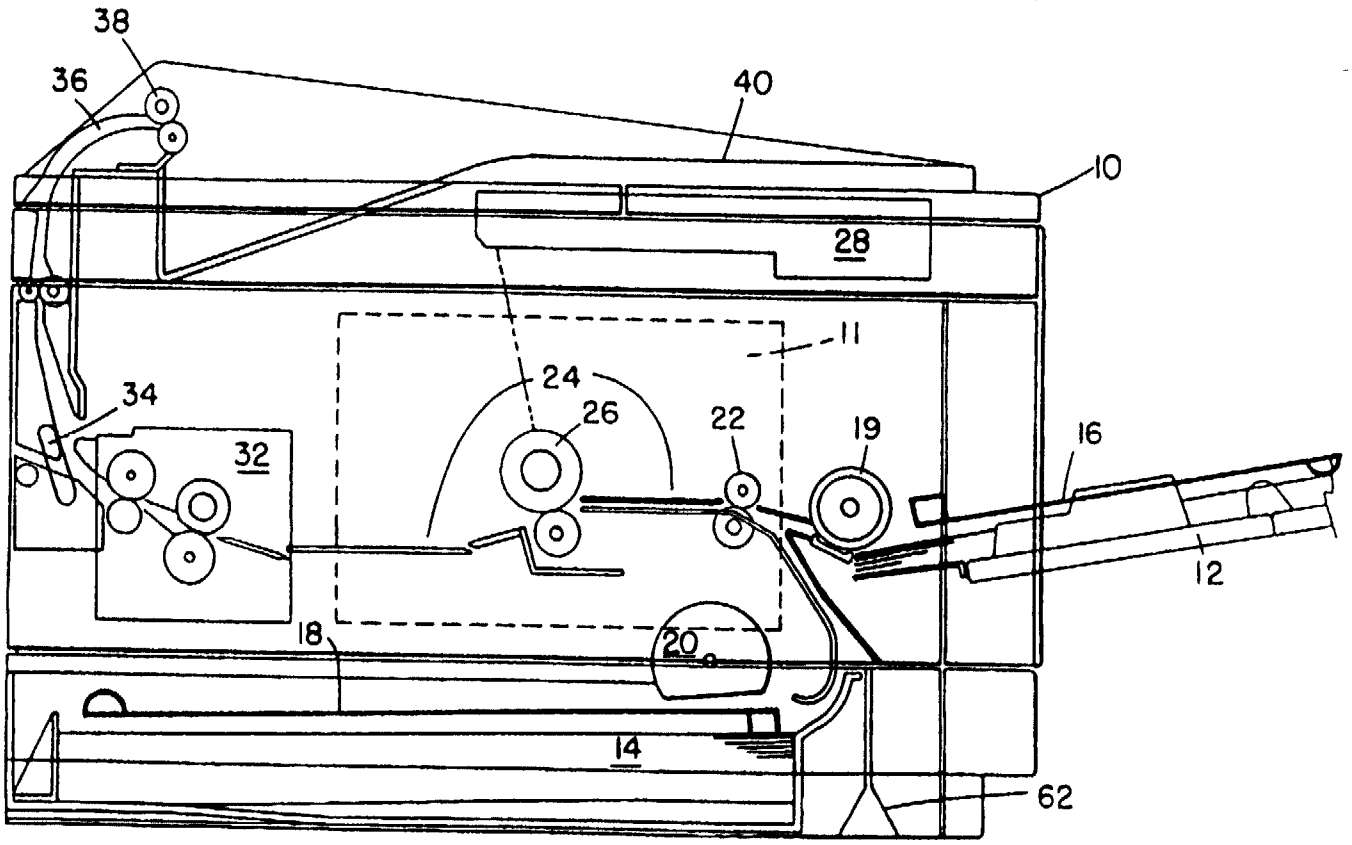
FIG. 1 is a cut away isometric view of an electrophotographic printer housing showing the paper path through the fuser in accordance with the present invention.

Referring first to FIG. 1, where a desk top laser printer 10 with a cutaway view is shown. One skilled in the art of electrophotographic printing will understand that this figure is a simplified diagram used to orient the reader as to the function of the present invention.

As stated earlier, the printer is generally comprised of five areas, which are visible in FIG. 1. Generally, media starts in one of the two separate pickup areas 19 or 20. The printer 10 picks up media 16 with roller 19 or media 18 with roller 20 depending on which source is designated by the printer 10. After the media is picked up, it is passed through registration rollers 22. The registration area ensures that the media is properly positioned prior to entering the imaging area 24. Once in the imaging area 24, as is known in the art of electrophotographic printing, an image is transferred from the photoconductive drum 26 to the media. With present technology laser printing systems, it is common practice to next pass the printed media, with the just printed text or graphics, into the fuser to burn in or fuse in the text or graphics on the media. This eliminates the possibility of smearing the media thus enhancing the permanent nature of the generated document. The fuser is heated to a temperature of about 180 degrees Celsius. At this temperature, the toner liquefies thereby fusing to the media. After leaving the fuser 32, the media enters the output area 36 and finally coming to rest in the output tray 40.

The present invention can be applied anywhere from the pickup roller in the input area to the output roller in the output area. For simplicity and consistency, the path between the fuser area and output area will be used to illustrate a preferred embodiment.

Figure 2:
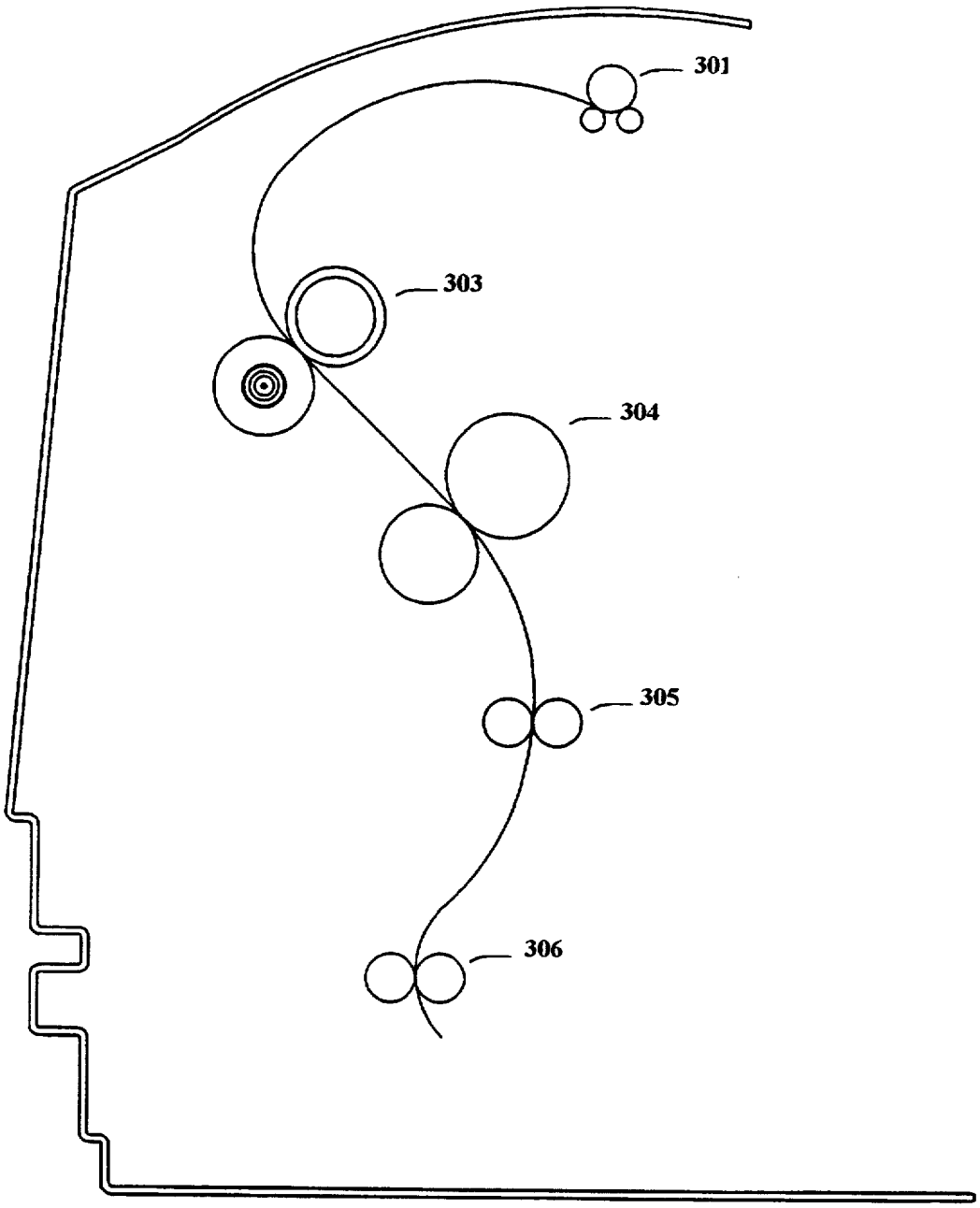
FIG. 2 shows a simplified paper path of an electrophotographic printer in accordance with the present invention.

FIG. 2 represents the paper path of FIG. 1 in a simplified diagram. Starting at the bottom of FIG. 2 media first enters paper pickup area 306. From there it is transported to registration area 305. Media then passes through imaging area 304, fuser 303 and finally output section 301. As stated earlier each one of the rollers in the individual areas must transport the media at the same linear velocity. If any one roller or area exhibits a different linear velocity the media will either be stretched or folded depending upon whether the linear velocity is higher or lower respectively.

Figure 3:
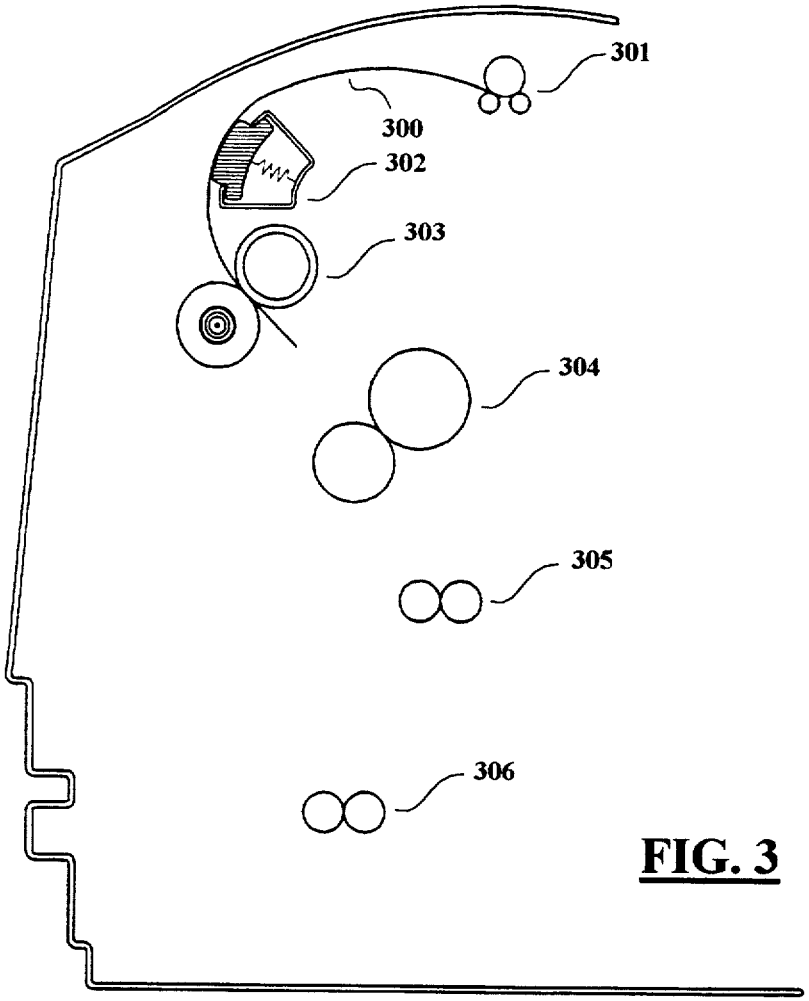
FIG. 3 uses the simplified paper path of FIG. 2 to show an embodiment in accordance with the present invention.

FIG. 3 shows a preferred embodiment of the present invention. Here, output rollers 301 are designed to have a slightly higher linear velocity than fuser rollers 303. This difference of linear velocities places media 300 under tension, thereby reducing the arc caused by the paper path. As the tension increases on media 300, media guide 302 begins to compress. The compression action of media guide 302 ensures a constant tension in media 300.

As stated earlier media guide 302 can be used in between any pair of rollers. However, in a typical electrophotography printer, as the media 300 exits the fuser area 303 the toner is still in a liquid state as a result of the high temperatures used in the fuser area 303. The media is also at an elevated temperature. This high temperature, for both toner and media, tends to leave the media in a plastic state. As a result, the media is more susceptible to buckling and stretching. Thus, the media guide is most effective when placed between fuser 303 and output 301.

It should be apparent to one skilled in the art that it is desirable that the newly printed image on media 300 face outward as it passes over media guide 302. This arrangement ensures that media guide 302 does not alter the newly printed image on media 300.

Figure 5:
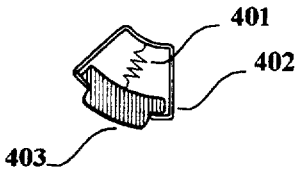
FIG. 5 shows the media guide in greater detail.
Figure 6:
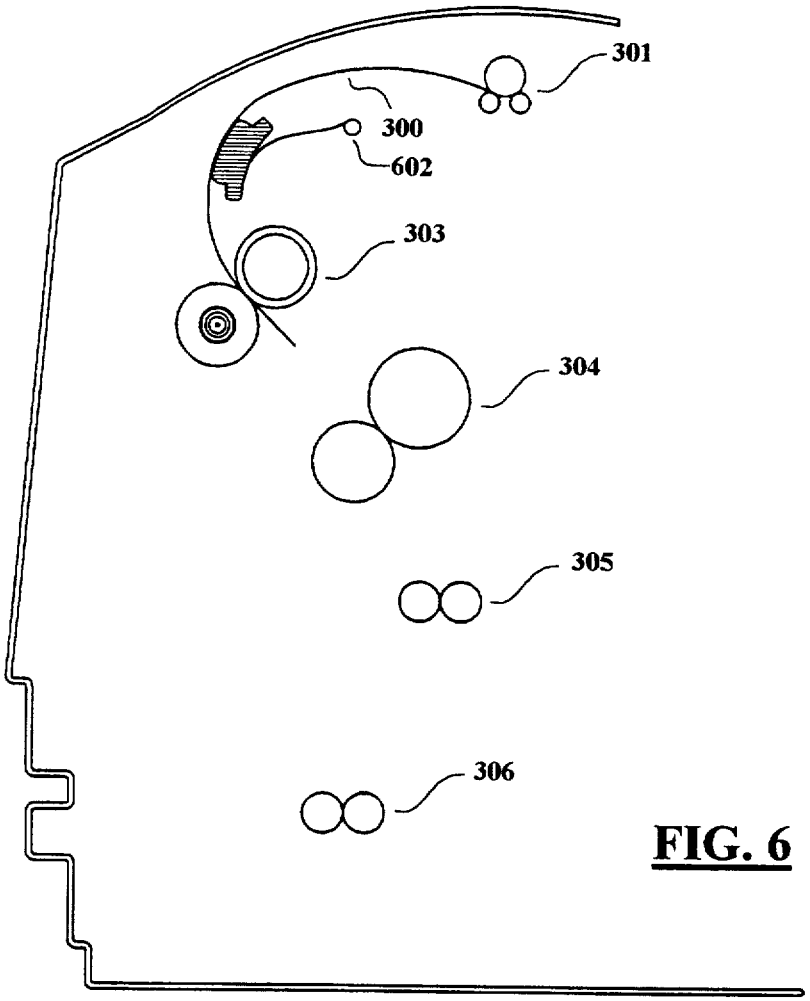
FIG. 6 is an alternative embodiment of the present invention.

Referring briefly to FIG. 5 where the media guide is shown in greater detail. Here it is clear that the media guide is constructed from housing 402, spring 401 and plunger 403. Plunger 403 should be made of a material that will not damage the media or create an unnecessary amount of friction. The spring constant of spring 401 is engineered such that plunger 403 will descend into housing 402 as the media is pulled across plunger 403. While FIG. 5 shows a spring, any spring material or arrangement can be used. Some alternatives to a spring include using a sponge type material, an air bag or other pneumatic arrangement, or the entire media guide can be one solid piece of compressible material thereby incorporating the plunger, spring and housing into one piece. FIG. 6 shows an alternative embodiment wherein the media guide is mounted on a spring loaded arm. Other embodiments are possible such as using a tempered arm.

Figure 4:
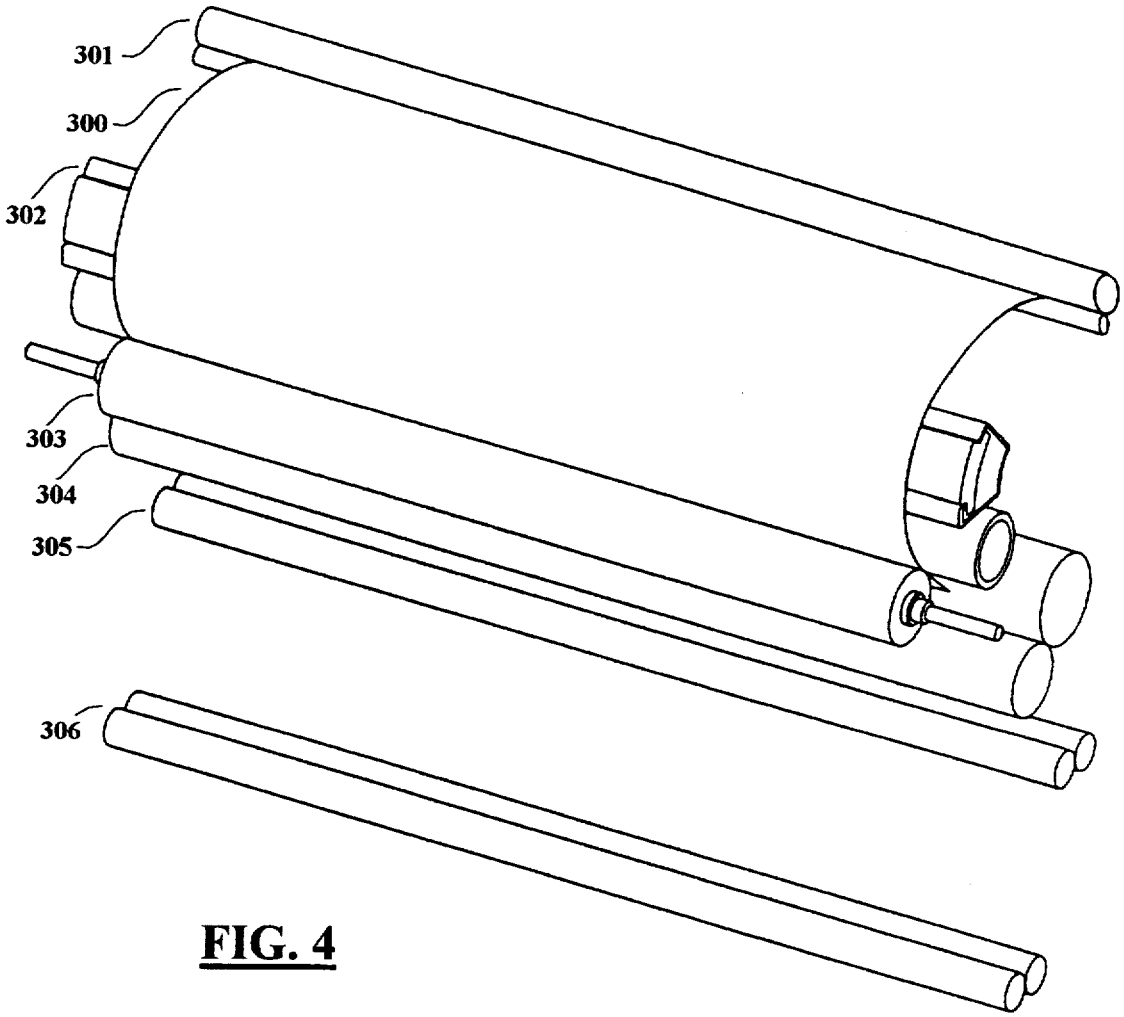
FIG. 4 is a three dimensional view of FIG. 3.

Finally, referring to FIG. 4 where the printer of FIG. 3 is shown in a three dimensional format. From this angle it is apparent that media guide 302 extends beyond the width of media 300. While this is not necessary for proper operation of media guide 302, it does ensure that media 300 is properly supported across its entire width.

In summary, the preferred embodiment uses a second roller with a faster linear velocity than a previous roller and a variable media path length between the two rollers. As the media is pulled into the second roller, the media guide is compressed creating a shorter media path length. As a result, uniform media tension is maintained. With uniform media tension during transport, many potential media deformations and jams can be minimized increasing the quality of the printed media.

Although the preferred embodiment of the invention has been illustrated, and that form described, it is readily apparent to those skilled in the art that various modifications may be made therein without departing from the spirit of the invention or from the scope of the appended claims.

What is claimed is:

1. An apparatus operative within an electrophotographic device for reducing deformation in a media, said apparatus comprising of:

a first roller assembly having a first infeed nip, a leading edge of said media enters said first infeed nip, said first roller assembly moves said media until a trailing edge of said media exits said infeed nip, said first roller assembly having a first linear velocity;

a second roller assembly having a second infeed nip, said leading edge of said media enters said second infeed nip prior to said trailing edge exiting said first infeed nip, said second roller assembly moves said media until said trailing edge of said media exits said second infeed nip, said second roller assembly having a linear velocity greater then said first linear velocity; and a compressible media guide between said first roller assembly and said second roller assembly.

2. An apparatus as claimed in claim 1 further comprising a variable media path through said electrophotographic device and between said first roller assembly and said second roller assembly, said variable media path having an arcuate shape, said compressible media guide being inside of said arcuate shape of said variable media guide.

3. An apparatus as claimed in claim 1 wherein said compressible media guide further comprising:

a housing having an inside;

a compressible material having a first side and a second side, said first side resting against said inside of said housing; and a plunger resting against said second side of said compressible material, said plunger making contact with said media.

4. An apparatus as claimed in claim 1 wherein said compressible media guide further comprising:

a skid making contact with said media; and a tension means for exerting a force, said tension means transferring said force through said skid.

5. An apparatus as claimed in claim 4 wherein said tension means is a spring loaded member.

6. An apparatus operative within an electrophotographic device for reducing deformation in a media, said apparatus comprising of:

a first roller assembly having a first infeed nip, a leading edge of said media enters said first infeed nip, said first roller assembly moves said media until a trailing edge of said media exits said infeed nip, said first roller assembly having a first linear velocity;

a second roller assembly having a second infeed nip, said leading edge of said media enters said second infeed nip prior to said trailing edge exiting said first infeed nip, said second roller assembly moves said media until said trailing edge of said media exits said second infeed nip, said second roller assembly having a linear velocity greater then said first linear velocity;

a variable media path through said electrophotographic device and between said first roller assembly and said second roller assembly, said variable media path having an arcuate shape; and a compressible media guide along said variable media path, said media guide being inside of said arcuate shape of said variable media path.

7. An apparatus as claimed in claim 6 wherein said compressible media guide further comprising:

a housing having an inside;

a compressible material having a first side and a second side, said first side resting against said inside of said housing; and a plunger resting against said second side of said compressible material, said plunger making contact with said media.

8. An apparatus as claimed in claim 6 wherein said compressible media guide further comprising:

a skid making contact with said media; and a tension means for exerting a force along a radii of said arcuate shape, said tension means transferring said force through said skid.

9. An apparatus as claimed in claim 8 wherein said tension means is a spring loaded member.

10. An apparatus operative within an electrophotographic device for reducing deformation in a media, said apparatus comprising of:

a first moving means for moving said media through said electrophotographic device, said first moving means moving said media at a first velocity;

a second moving means for moving said media through said electrophotographic device said second moving means receives said media from said first moving means, said second moving means moving said media at a second velocity where said second velocity is greater then said first velocity;

a variable media path through said electrophotographic device and between said first moving means and said second moving means; and a tensioning means for keeping said media under a constant tension while said media is moving through said variable media path thereby reducing deformation in said media.

11. An apparatus as claimed in claim 10 wherein said variable media path having an arcuate shape.

12. An apparatus as claimed in claim 11 wherein said tensioning means further comprising:

a plunger means resting against a compressible means, said plunger means making contact with said media and being inside of said arcuate shape of said variable media path, said plunger means being forced into said compressible means by said media as said variable media path decreases as a result of said second velocity.

13. An apparatus as claimed in claim 12 wherein said compressible means is a spring loaded member.

* * * * *